US005273277A

United States Patent [19]

Freese

[11] Patent Number: 5,273,277

[45] Date of Patent: Dec. 28, 1993

[54] BALL HITTING TRAINING DEVICE

[76] Inventor: Eldon D. Freese, 2980 200th St., Manson, Iowa 50563

[21] Appl. No.: 955,451

[22] Filed: Oct. 2, 1992

[51] Int. Cl.[5] ..... A63B 69/40

[52] U.S. Cl. ..... 273/26 E; 273/29 A; 273/184 B

[58] Field of Search ..... 273/26 E, 191 R, 191 B, 273/184 B, 26 R, 192, 196, 197 R, 197 A, 200, 200 A, 26 EA, 200 B, 29 A

[56] References Cited

U.S. PATENT DOCUMENTS

| | | | |
|---|---|---|---|
| 2,219,732 | 10/1940 | Armstrong | 273/26 E |
| 2,305,187 | 12/1942 | Nelden | 273/26 E |
| 2,985,452 | 5/1961 | Trippel | 273/26 R |
| 3,194,557 | 7/1965 | Holley | 273/26 E |
| 3,397,885 | 8/1968 | Nash, Jr. | 273/26 E |
| 3,904,199 | 9/1975 | Burchett | 273/26 R |
| 3,937,464 | 2/1976 | Zalewski | 273/26 R |
| 3,940,313 | 2/1976 | Claire, Jr. | 273/26 R |
| 3,948,517 | 4/1976 | Feiler | 273/29 A |
| 4,191,372 | 3/1980 | Keller | 273/26 E |
| 4,451,036 | 5/1984 | Sinclair et al. | 273/26 R |
| 4,496,156 | 1/1985 | Centafanti | 273/184 B |
| 4,861,035 | 8/1989 | Page | 273/184 B |
| 5,087,039 | 2/1992 | Laseke | 273/26 R |

FOREIGN PATENT DOCUMENTS

| | | | |
|---|---|---|---|
| 246988 | 2/1987 | United Kingdom | 273/184 B |

*Primary Examiner*—Theatrice Brown
*Attorney, Agent, or Firm*—Zarley, McKee, Thomte, Voorhees, & Sease

[57] ABSTRACT

A ball hitting training device has a support frame comprised of vertically disposed telescopically adjustable posts. A horizontally disposed straight hitting guide is secured to the support frame. A ball support apparatus is secured to the support frame and includes a C-shaped bracket with an upper member dwelling above the hitting guide. The upper member supports the upper end of a flexible cable having a ball secured to the lower end at a position in the plane of and just above the upper surface of the hitting guide.

12 Claims, 2 Drawing Sheets

BALL HITTING TRAINING DEVICE

BACKGROUND OF THE INVENTION

Training devices for teaching young people the fundamentals of hitting a baseball or softball are commonplace. However, the existing devices do not emphasize the importance of swinging the bat in a level or horizontal plane. Further, they are not readily adaptable to teaching this concept wherein players of different stature can learn the skill of swinging the bat in a level plane in a strike zone dictated by the batter's height.

It is therefore a principal object of this invention to provide a ball hitting training device that will teach a player the concept of swinging a bat in a level plane to hit a baseball or a softball.

A further object of this invention is to provide a ball hitting training device that can be selectively adjusted to accommodate players of different heights.

A still further object of this invention is to provide a ball hitting training device that can teach hitting skills to either a baseball or a softball player.

A still further object of this invention is to provide a ball hitting training device that is safe and is useful by players of different ages having different levels of skill.

These and other objects will be apparent to those skilled in the art.

SUMMARY OF THE INVENTION

The ball hitting training device of this invention includes a support frame comprised of vertically disposed telescopically adjustable posts. A horizontally disposed straight hitting guide is secured to the support frame. A ball support apparatus is secured to the support frame and includes a C-shaped bracket with an upper member dwelling above the hitting guide. The upper member supports the upper end of a flexible cable having a ball secured to the lower end at a position in the plane of and just above the upper surface of the hitting guide.

DESCRIPTION OF THE PREFERRED EMBODIMENT

Figure 1:
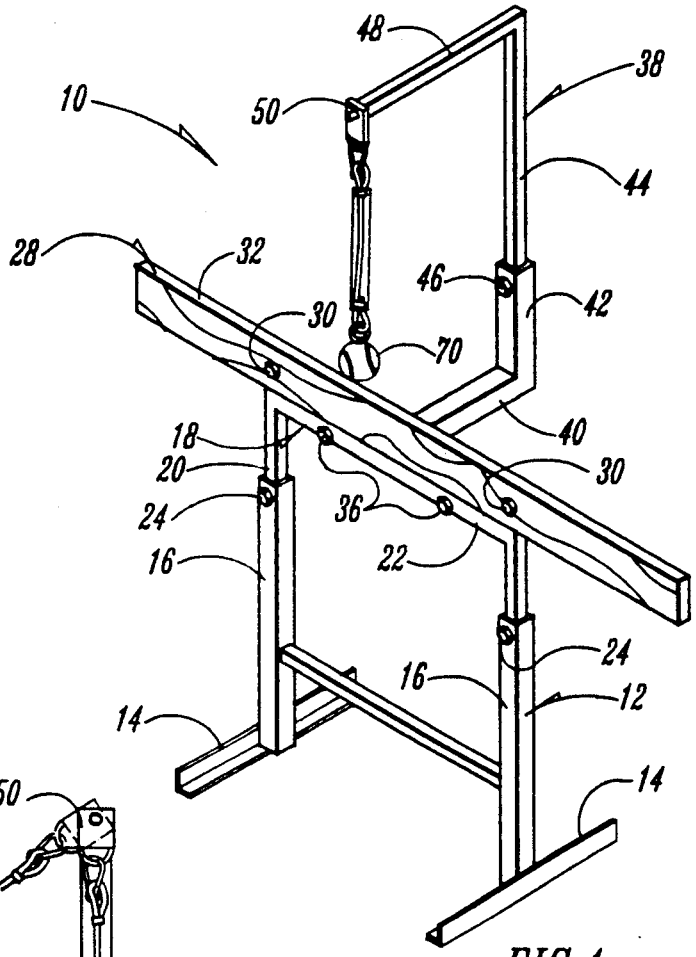
FIG. 1 is a perspective view of the ball hitting training device of this invention.
Figure 2:
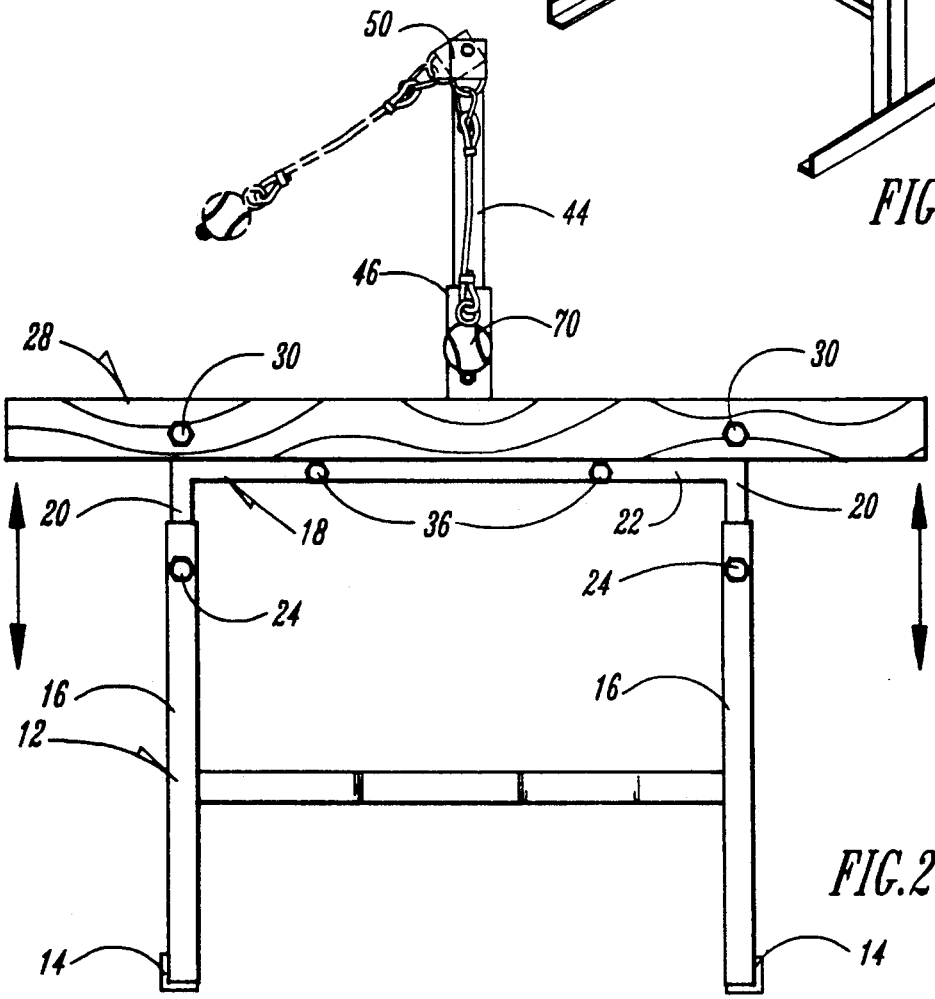
FIG. 2 is a front elevational view thereof.

The ball hitting training device 10 has a support frame 12 which includes two horizontally disposed ground engaging members 14. Upstanding square hollow tubes or posts 16 are welded by their lower ends to the members 14 as best shown in FIG. 1.

Figure 3:
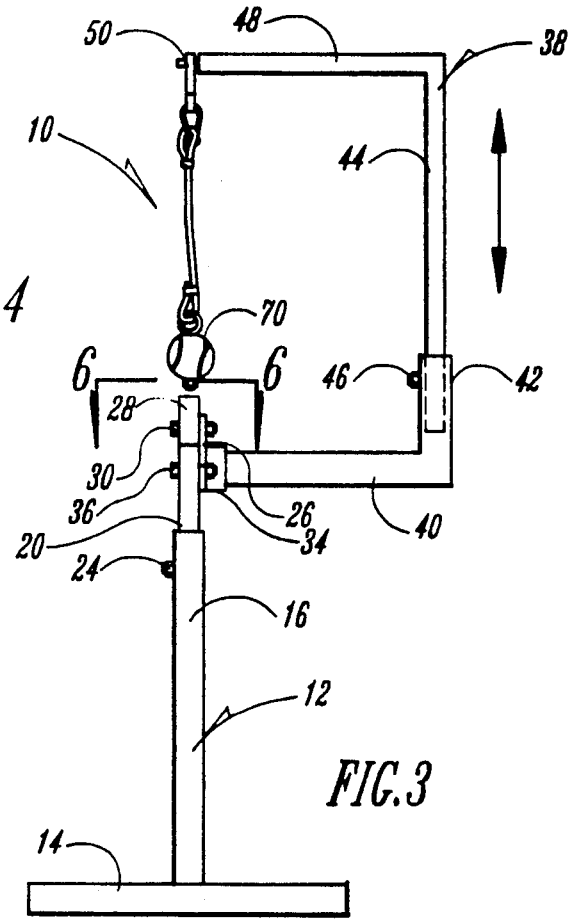
FIG. 3 is an end elevational view thereof.
Figure 6:
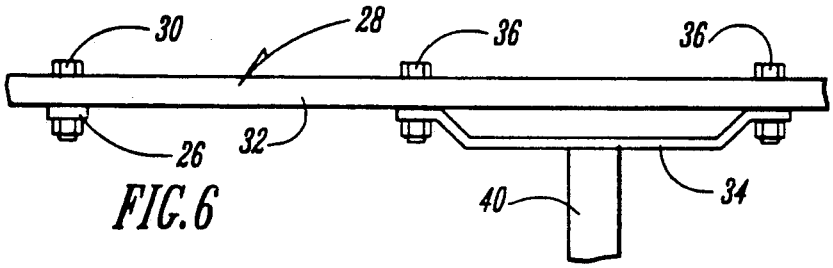
FIG. 6 is a partial sectional view taken on line 6-6 of FIG. 3.

An inverted U-shaped frame 18 has vertical legs 20 which are telescopically inserted into the upper ends of tubes 16. The upper ends of the vertical legs 20 are secured together by cross member 22. The members 20 and 22 are also preferably comprised of hollow square tube components. Set screws 24 are adapted to secure the frame 18 at any desired height level with respect to the posts 16. Vertical straps 26 are welded to cross member 22 as shown in FIGS. 3 and 6. A hitting guide

28 is supported by straps 26 through the use of bolt and nut assemblies 30. Hitting guide 28 is preferably comprised of wood and has a straight horizontal upper surface 32.

With reference to FIG. 6, a bracket 34 is secured to cross member 22 by means of bolt and nut assemblies 36. A C-shaped bracket 38 having a horizontal lower member 40 is secured by welding or the like to bracket 34. An upstanding member 42 is welded to the rearward outer end of member 40 and telescopically receives the vertical upstanding member 44. Set screw 46 selectively adjusts the height of member 44 with respect to the member 42. A horizontal upper member 48 is welded by its rearward end to the upper end of member 44. The members 40, 42, 44 and 48 are preferably comprised of square hollow tubing.

Figure 5:
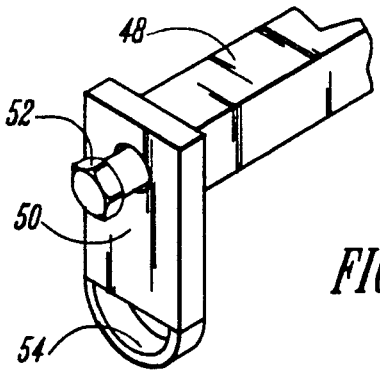
FIG. 5 is a perspective view of the cable support element of FIG. 4.

A support element 50 is secured to the forward end of horizontal upper member 48 by horizontal bolt 52 (FIG. 5). A semicircular loop element 54 is rigidly secured to the lower end of support element 50. A clevis 56 is swingably secured to loop 54 and supports cable 58. Cable 58 has an upper loop 60 formed in its upper end and a lower loop 60 formed as its lower end with the loops being maintained by conventional cable retainers 64. An eye-bolt 66 has an upper eyelet 68 terminating in a shank 69 which extends through a bored aperture in ball 70. A nut 72 on the lower end of shank 69 secures the ball to the eye-bolt 66.

A plastic tube 74 or the like can be positioned around cable 58 to protect the cable and the bat in the remote event that the batter accidently strikes the cable during a practice swing.

It should be noted that the position of ball 70 with respect to the hitting guide 32 is such that the ball dwells in the plane of the hitting guide in close proximity to the upper straight horizontal surface 32 of the guide. The guide is placed at a height in accordance with the stature of the player so that the player is comfortable in making a horizontal swing directly above the upper horizontal surface 32 of the guide. The height of the guide is determined by selectively adjusting the vertical legs 20 in the upstanding tubes 16 by means of set screws 24.

In the event that the device is to be used with a softball rather than a baseball, with the softball having a greater diameter than the baseball, the set screw 46 can be used to permit the member 44 to be raised with respect to the member 42 so as to accommodate the greater diameter of the softball. This procedure can be reversed for changing the apparatus from a softball mode to a baseball mode.

Figure 4:
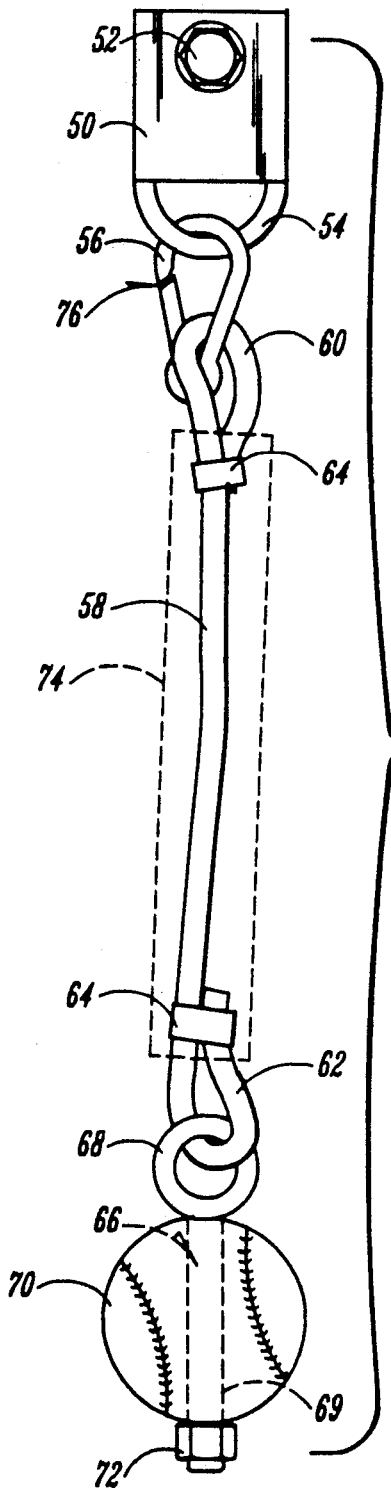
FIG. 4 is an enlarged scale elevational view of the flexible cable that supports the ball being hit.

The cable 58 can be removed from clevis 56 through the conventional operation of the clevis which is accommodated by the resilient structure of the clevis and break portion 76 (FIG. 4) of the clevis.

It is therefore seen that the device of this invention will therefore achieve at least its stated objectives.

I claim:

1. A ball hitting training device for teaching baseball players to swing horizontally through a baseball strike zone, comprising, a support frame adapted for mounting on a support surface, a horizontally disposed elongated straight hitting guide secured to said support frame, and being secured to said support frame at a location substantially elevated above said support surface to extend through said strike zone, an elongated ball support means secured to said support frame, said ball support means having an axis extending substantially perpendicular to said hitting guide, a ball swingably mounted on said ball support means in close proximity to said hitting guide so that a swung bat passing horizontally directly over and along the length of said hitting guide will strike said ball without striking said hitting guide and cause said ball to swing in a plane substantially parallel to said hitting guide.

2. The device of claim 1 wherein said support means includes means for adjusting the height of said hitting guide.

3. The device of claim 1 wherein said ball support means includes means for adjusting the height of said ball with respect to said hitting guide.

4. The device of claim 2 wherein said ball support means includes means for adjusting the height of said ball with respect to said hitting guide.

5. The device of claim 1 wherein said support frame includes vertical telescopically adjustable post means secured to and supporting said hitting guide.

6. The device of claim 1 wherein said ball support means includes a C-shaped bracket secured to said support frame and extending at a right angle with respect to said support frame, and having an upper support element dwelling in spaced relation over said hitting guide, said ball support means secured to said support element.

7. The device of claim 6 wherein said C-shaped bracket includes means for selectively adjusting the height of said upper support element.

8. The device of claim 1 wherein said ball support means includes an elongated flexible member having opposite ends, with one end being secured to said ball, and the other end being secured to a swivel element.

9. The device of claim 8 wherein a bat protective means surrounds said flexible member.

10. The device of claim 1 wherein said hitting guide is comprised of wood.

11. The device of claim 1 wherein said hitting guide has a width less than the diameter of said ball.

12. The device of claim 1 wherein said hitting guide is free from any vertical protrusions so as to permit a bat to be swung thereover without interference.

* * * * *